US005974977A

United States Patent [19]

Johnson et al.

[11] Patent Number: 5,974,977

[45] Date of Patent: Nov. 2, 1999

[54] MAGNETIC PROPULSION TOY SYSTEM

[75] Inventors: Lonnie G. Johnson, Smyrna; Yong Su, Atlanta, both of Ga.

[73] Assignee: Johnson Research & Development Company, Inc., Smyrna, Ga.

[21] Appl. No.: 08/939,221

[22] Filed: Sep. 29, 1997

[51] Int. Cl.[6] ..... A63G 1/00

[52] U.S. Cl. ..... 104/60; 104/292; 104/295; 104/281; 446/133; 446/429; 463/61

[58] Field of Search ..... 446/429, 129, 446/133; 463/61; 104/138.1, 281, 282, 290, 292, 295, 165, 53, 60, 304, 305

[56] References Cited

U.S. PATENT DOCUMENTS

| | | | |
|---|---|---|---|
| 2,218,164 | 10/1940 | Carpenter | 273/86 |
| 3,299,565 | 1/1967 | Yarashes | 46/235 |
| 3,622,158 | 11/1971 | Tepper et al. | 273/86 |
| 3,927,620 | 12/1975 | Clapham | 104/148 |
| 4,658,928 | 4/1987 | Seo | 180/168 |
| 5,165,347 | 11/1992 | Wagner | 104/283 |
| 5,480,333 | 1/1996 | Larson | 104/295 |
| 5,507,679 | 4/1996 | Getsay | 104/138.1 |
| 5,666,101 | 9/1997 | Cazzani et al. | 340/323 |

*Primary Examiner*—Christopher P. Schwartz
*Assistant Examiner*—Robert J. McCarry, Jr.
*Attorney, Agent, or Firm*—Kennedy, Davis & Hodge

[57] ABSTRACT

A magnetic propulsion toy system is provided having a track (11), a boost station (12) and a car (14) made of magnetic material. The boost station has control circuit (18) with a battery (19), a wire coil (21), a capacitor (22), a manual triggering switch (24), an automatic triggering switch (27) and a manual delay triggering switch (29). An infrared emitter/detector (28) is coupled to the automatic triggering switch and manual delay triggering switch.

22 Claims, 3 Drawing Sheets

FIG. 1
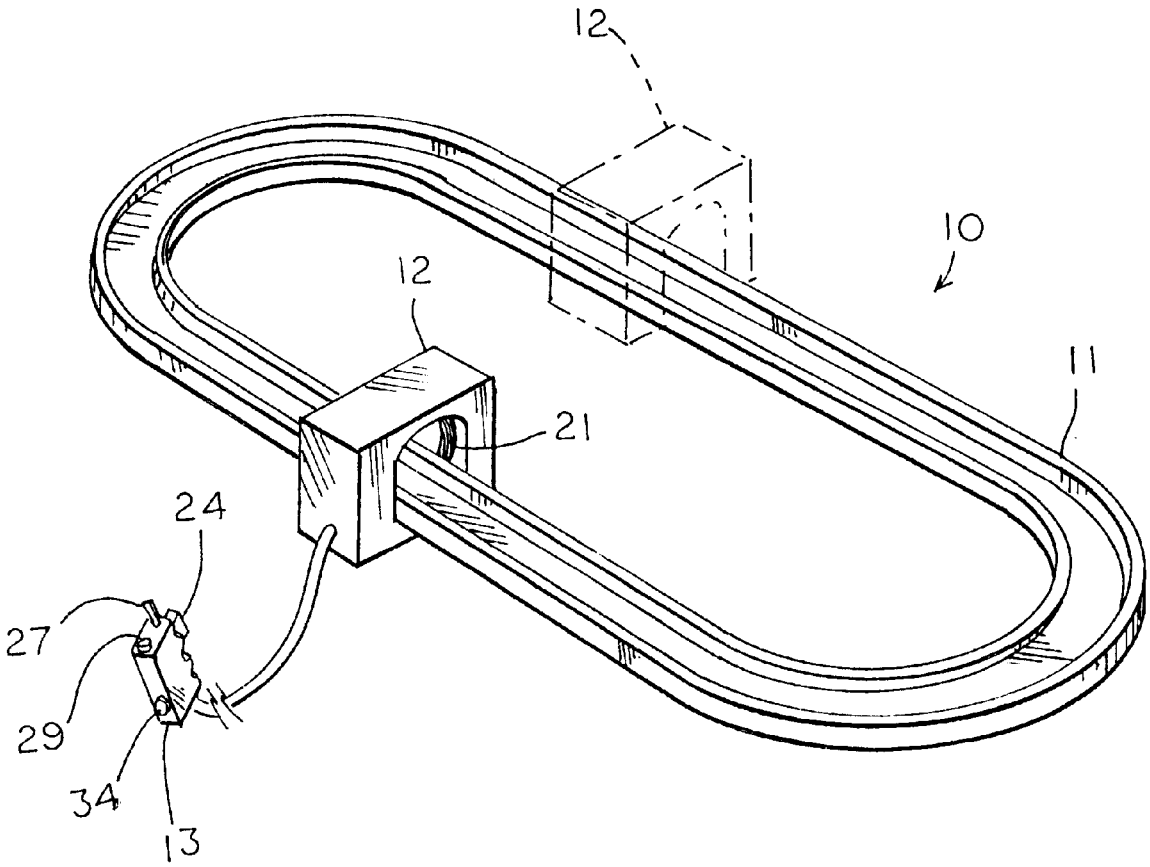
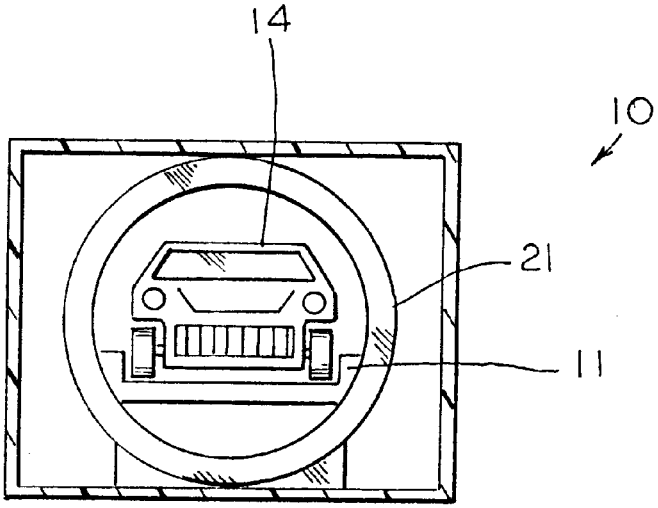
FIG. 2

MAGNETIC PROPULSION TOY SYSTEM

TECHNICAL FIELD

This invention relates generally to magnetic propulsion toy systems and more specifically to toy systems having an electromagnetic coil for propelling a vehicle.

BACKGROUND OF THE INVENTION

Toy racetrack systems in which toy vehicles are raced around a track have existed for many years. These racetracks systems have propelled or driven the car about the track in a variety of different manners.

One popular racetrack system which has been developed utilizes a partially elevated track so that a car placed upon the track is gravitationally accelerated down a slope and along the track. This racetrack system is somewhat limiting since the car must be manually set back upon the elevated portion of the track each time it is raced.

Another popular racetrack system utilizes a car with an electric motor and a racetrack with an electric power supply with embedded electrode rails along the entire length of the racetrack. An operator controls the speed of the car by controlling the voltage potential between the rails. This type of system is commonly referred to as a slot car set. The tracks of these systems are comprised of several segmented sections which are coupled together end to end. However, over time the electrical connectors between the rails of these sections become worn, bent or broken, rendering the track inoperative. These race car sets also do not require a great deal of skill to operate and therefore their operators quickly lose interest in their operation.

Racetrack systems have also been designed with boost stations which accelerate the car forward by placing a force upon the car. One type of boost station utilizes two spinning wheels between which the car is passed so that the spinning wheels propel the car forward. Another type of boost stations has been designed which utilize an electromagnetic coil sized and shaped to encircle the track and a car made of magnetic material. Current is passed from a battery through the electromagnetic coil so that a magnetic field is created which causes the car to accelerate, as shown in U.S. Pat. No. 2,218,164. As the boost from these systems is quite weak, this system must utilize several boost stations in order to propel the car completely around the track. The use of several boost stations is inefficient and costly. Also, should the electromagnetic coil be energized after the car has passed the center of the coil the resulting magnetic field will pull the car backwards towards the coil. This backwards pull will retard, stop or reverse the direction of the car. This may result even if the operator properly commences the energization of the coil but then delays releasing the trigger and thus stopping the energization.

It thus is seen that a need remains for a system for propelling a car around a track in a manner which requires operator skillfulness and yet in an efficient manner. It is to the provision of such that the present invention is primarily directed.

SUMMARY OF THE INVENTION

In a preferred form of the invention, there is shown a magnetic propulsion toy system having a track, a vehicle adapted to ride upon the track of which at least a portion is made of a magnetic material. A wire coil is mounted about a portion of the track for passage of the vehicle therethrough. An electric power source is coupled to the wire coil and a control circuit coupled to the power source and the wire coil which controls the passage of current to the wire coil. The control circuit includes a manual triggering switch and time limiting means coupled to the manual triggering switch for limiting the time the wire coil is energized. With this construction, actuation of the manual triggering switch causes energy from the battery to be passed to the coil to produce a magnetic field for a selected period of time.

BRIEF DESCRIPTION OF THE DRAWINGS

FIG. 1 is a perspective view of a magnetic propulsion toy system of the present invention shown in a preferred form of a car racetrack.

FIG. 2 is a cross sectional view of the toy system of FIG. 1.

DETAILED DESCRIPTION

Figure 3:
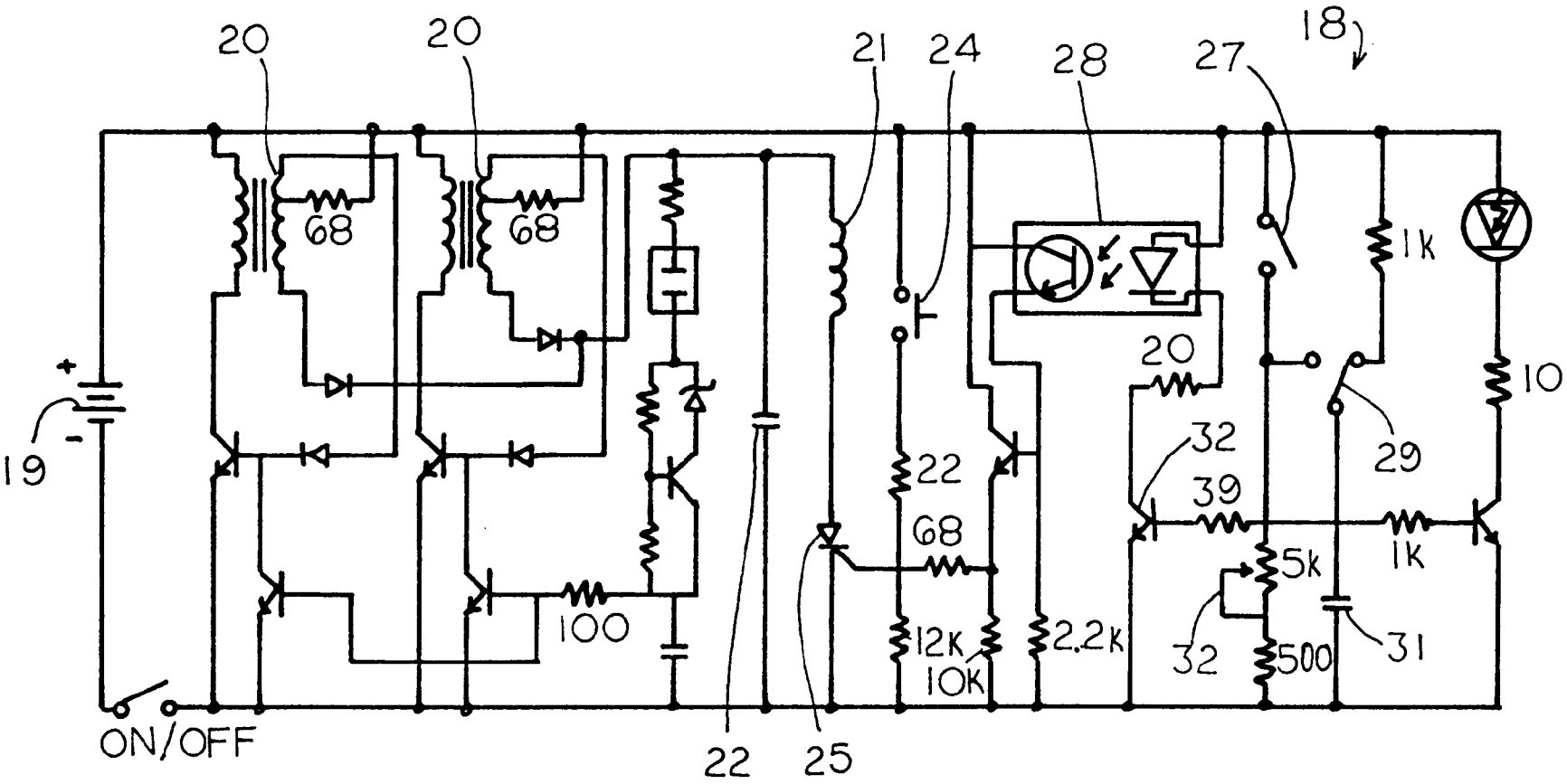
FIG. 3 is a circuit diagram of the toy system of FIG. 1.

With reference next to the drawing, there is shown a magnetic propulsion toy system in the form of a car raceway 10. The raceway has a track 11, a boost station 12 having a hand control 13, and a race car 14. The race car 14 is made of magnetic material, such of soft steel, or of non-magnetic material with a bar of magnetic material extending through the race car.

As shown in FIG. 3, the boost station has a control circuit 18 having a 3 volt d.c. battery 19. An inverter circuit having a pair of oscillators 20, a coil 21, a capacitor 22, and a manual triggering switch 24 are all connected across the battery 19. The manual triggering switch 24 is coupled to capacitor 22 through a transistor or SCR 25. An automatic triggering switch 27, an infrared emitter/detector 28, and a manual delay triggering switch 29 are connected across the battery. A capacitor 31 is coupled to the manual delay triggering switch 29 such that the stored energy released from capacitor 31 through actuation of the manual delay triggering switch 29 turns on a transistor 32 which in turn energizes IR emitter/detector 28. Switches 24, 27 and 29 are mounted upon the hand control 13.

In manual operation, the battery/oscillator combination charges the capacitor 22 to a maximum voltage of approximately 400 volts and the car 14 is placed upon the track 11 immediately before the boost station 12. Manual action of the manual triggering switch 24 causes the stored energy within capacitor 22 to be passed to coil 21, thereby creating a sharp and strong magnetic field associated with the coil. This magnetic field causes the car to be rapidly pulled into the coil. The magnetic field about the coil quickly diminishes and is therefore minimal by the time the car approaches the center of the coil. The acceleration of the car as a result of the magnetic pull causes the car to be propelled completely about the racetrack. As the car once again approaches the boost station the operator manually actuates the manual triggering switch 24 to cause the discharge of the capacitor 22, which by then has been fully recharged by the battery/oscillator combination. The operator continues to actuate the manual triggering switch until the race is complete.

The manual operation of the manual triggering switch requires a high degree of skill in order to time accurately the energization of the coil for maximum acceleration of the car. For if the manual triggering switch is actuated too early the car will be too far from the coil magnetic field and the effects of the magnetic field upon the car will be weak. Conversely, if the switch is actuated too late the car will pass past the center of the coil before the magnetic field has dissipated, which will result in the magnetic field actually retarding the acceleration of the car, i.e. the magnetic field will pull the car in a direction opposite to the direction of travel. Hence, the operator must become proficient in the operation of the manual triggering switch in order to achieve a maximum and continuous car velocity.

The operator may choose to operate the system in a fully automated mode of operation. To do so the operator closes the automatic triggering switch 27 which in turn energizes the IR emitter/detector 28. As the car approaches the boost station 12 the presence of the car is detected by the IR emitter/detector 28 which then turns on transistor 25 causing the energy within the capacitor 22 to be passed to the coil 21. The energization of the coil creates a magnetic field which propels the car through the boost station and about the racetrack. The car will continue to be propelled about the track until the system is turned off, the automatic triggering switch is opened, or the power supply is depleted.

The less skilled or novice operator may choose a semi-automatic mode of operation which does not require the precision of the fully manual mode previously described. Here, as the car approaches the boost station the operator actuates the manual delay triggering switch 29 to its closed position. The closing of the switch causes the energy within capacitor 31 to drain for a selected period of time to transistor 32. The passage of energy to transistor 32 cause it causes it to be turned on for the selected period of time, thus energizing the IR emitter/detector 28 for that period of time. Should the car reach a position to be sensed by the IR emitter/detector within this time period the capacitor 31 is discharged to the coil as previously described. A rheostat 34 coupled to the manual delay triggering switch determines the selected length of time the IR emitter/detector is energized.

This operation of the toy system allows one who is not skilled at the game to still operate the firing of the boost station to achieve car acceleration without having to be very precise. For example, the operation of the manual delay triggering switch may trigger the energizing of the IR emitter/detector for one second. Hence, the operator need only operate the triggering switch within one second from the proper positioning of the car in order to achieve a maximum boost. Also, as one becomes more skilled at properly triggering the boost station the rheostat 34 may be adjusted so as to reduced the selected time period in order to challenge the operator. It should be understood that the time interval may be reduced to nearly zero so that the manual delay triggering switch becomes the equivalent of the manual triggering switch.

It should be understood that the manual triggering switch, automatic triggering switch and manual delay triggering switch are not dependent upon one another. As such, these triggers may be included in the control circuit alone or in combination with one or more of the other triggering switches.

Figure 4:
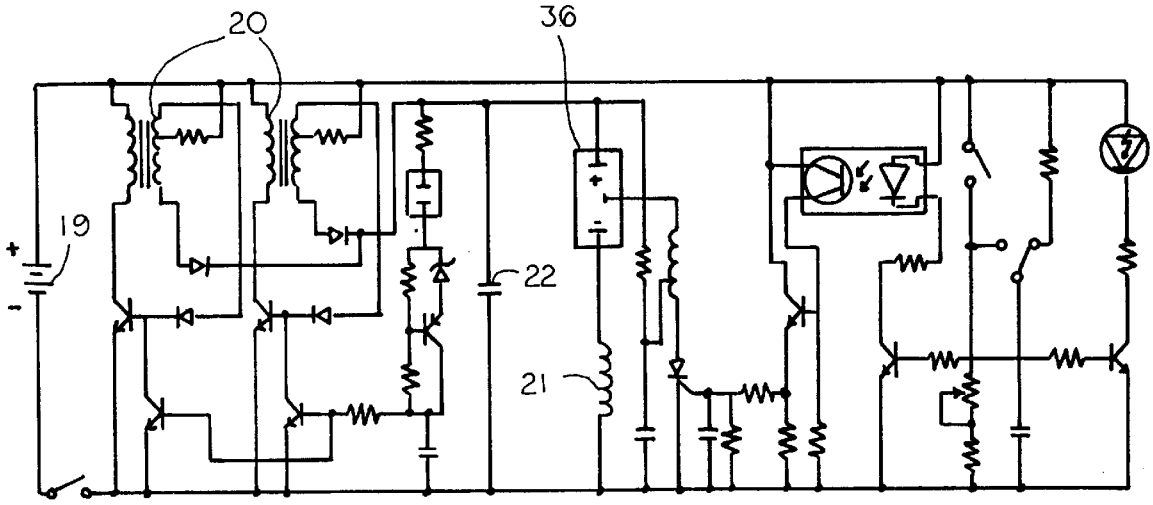
FIG. 4 is another alternative embodiment of a portion of the circuit diagram shown in FIG. 3.

With reference next to FIG. 4, there is shown a control circuit wherein the manual triggering switch is eliminated. The control circuit also includes a light flash unit 36 coupled across the battery 19. The discharge of the capacitor to the coil 21 also energizes the light flash unit 36 so as to cause a flash of light to be produced as the car passes through the boost station. The flash of light produces a dramatic effect which enhances the operation of the system.

Figure 5:
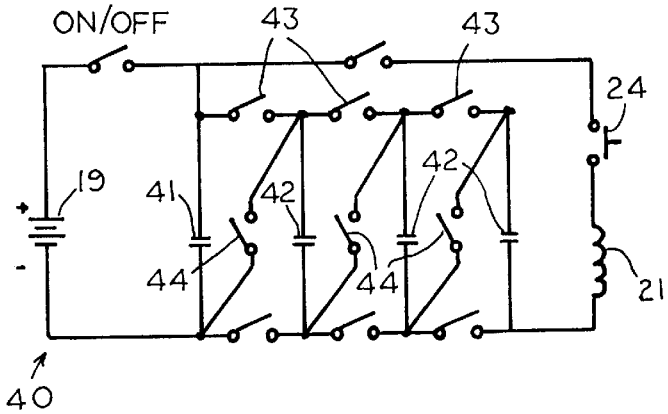
FIG. 5 is an alternative embodiment of the circuit diagram shown in FIG. 3.

Referring next to FIG. 5, there is shown an alternative circuit 40 having the capacitor 22, coil 21 and manual triggering switch 24 previously described. Here, the circuit 40 has a first capacitor 41 and three following capacitors 42. Each following capacitor 42 is associated with a charging switch 43 and an operating switch 44. In charging the capacitors 41 and 42 the charging switches 43 are closed while the operating switches 44 are open to charge the capacitors in parallel series. After the capacitors are fully charged the positions of the switches 43 and 44 are reversed so that the charging switches 43 are open and the operating switches 44 are closed. As such, with the closure of the manual triggering switch 24 the capacitors 41 and 42 are discharged in series circuit. This circuit provides a quick recharging of the capacitors and a strong magnetic field having a higher peak current upon discharge.

It should be understood that the provision of a capacitor in connection with the coil provides a critical improvement over the prior art devices which had the coil coupled directly to the battery. The prior art coupling of the coil to the battery limits the energy supplied to the coil to that of the battery. The present invention incorporates a capacitor which is capable of quickly supplying approximately 400 volts to the coil. The substantial increase in energy dramatically increases the power of the boost station and thus the acceleration of the car without having to rely upon a high voltage battery. Also, as the internal resistance of a capacitor is significantly lower than that of a battery, as such the resulting magnetic field of a coil associated with a capacitor charged to a selected voltage is greater than the resulting magnetic field of a coil associate with a battery of the same voltage. Another distinct advantage over the prior art devices is the sharp energization of the coil, i.e. short and strong pulse of power provided by the capacitor to the coil. This sharp energization not only provides a much stronger magnetic field as compared with those of the prior art but also provides an magnetic field which is limited in time duration since it is created by energy supplied by the capacitor. This time limit decreases the likelihood that the car will pass past the center of the coil while the coil is still energized, which would result in the car being pulled in the reverse direction. The prior art devices were coupled directly to the battery so that their coils were energized as long as the triggers were closed. As such, the operator must not only actuate the trigger at the proper time to cause the acceleration of the car but also quickly release the trigger at the proper time to prevent a reversal or deceleration of the car. Thus, the capacitor 22 works as both a means for limiting the energization time of the coil and means for storing energy for the energization of the coil. Capacitor 31 also is considered a means of controlling the timing of the automatic triggering switch 27 and manual delay triggering switch 29, and thus the firing the of the coil.

It should also be understood that the present system may be designed to include multiple tracks and boost stations so that several cars may simultaneously be raced against each other. Also, the track may include a boost station which is manually or semi-manually operated and a boost station which is automatically operated. With this configuration, should the operator fail to operate the manual boost station at the proper time the automatic boost station still provides enough power to accelerate the car completely about the track. The system may also utilize an a.c. current as an alternative to the battery/oscillator combination described herein. Lastly, it should be understood as an alternative to the IR emitter/detector previously describe most any other type of sensor or switch may be used which detects the presence of the car adjacent the boost station.

It thus is seen that a magnetic propulsion toy system is now provided which generates a sharp magnetic field. While this invention has been described in detail with particular references to the preferred embodiments thereof, it should be understood that many modifications, additions and deletions, in addition to those expressly recited, may be made thereto without departure from the spirit and scope of the invention as set forth in the following claims.

We claim:

1. A magnetic propulsion toy system comprising:

a track;

a vehicle adapted to ride upon said track, at least a portion of said vehicle being made of a magnetic material;

a wire coil mounted about a portion of said track for passage of said vehicle therethrough;

an electric power source coupled to said wire coil;

and a control circuit coupled to said power source and said wire coil which controls the passage of current to said wire coil, said control circuit includes a manual triggering switch and time limiting means coupled to said manual triggering switch for limiting the time said wire coil is energized to a selected time interval, said time limiting means comprising a capacitor, whereby actuation of the manual triggering switch causes energy from the electric power source to be passed to the coil to produce a magnetic field for a selected period of time.

2. A magnetic propulsion toy system comprising:

a track;

a vehicle adapted to ride upon said track, at least a portion of said vehicle being made of a magnetic material;

a wire coil mounted about a portion of said track for passage of said vehicle therethrough;

an electric power source coupled to said wire coil;

and a control circuit coupled to said power source and said wire coil which controls the passage of current to said wire coil, said control circuit includes a manual triggering switch and time limiting means coupled to said manual triggering switch for limiting the time said wire coil is energized to a selected time interval, said control circuit also including a manual delay triggering switch and a sensor coupled to said manual delay triggering switch and mounted adjacent said wire coil, whereby actuation of the manual triggering switch causes energy from the electric power source to be passed to the coil to produce a magnetic field for a selected period of time, and whereby manual actuation of the delay triggering switch enables the sensor for a selected time period and wherein the sensed position of the vehicle by the sensor causes the voltage within the capacitor to be passed to the wire coil which causes the magnetic force which magnetically effects the vehicle.

3. The magnetic propulsion toy system of claim 2 wherein said manual delay triggering switch has time variable means for varying the length of the selected time period said sensor is enabled.

4. The magnetic propulsion toy system of claim 2 wherein said sensor is an infrared light emitter and detector.

5. A magnetic propulsion toy system comprising:

a track;

a vehicle adapted to ride upon said track, at least a portion of said vehicle being made of a magnetic material;

a wire coil mounted about a portion of said track for passage of said vehicle therethrough;

an electric power source coupled to said wire coil;

and a control circuit coupled to said power source and said wire coil which controls the passage of current to said wire coil, said control circuit includes a manual triggering switch and time limiting means coupled to said manual triggering switch for limiting the time said wire coil is energized to a selected time interval, said control circuit also includes an automatic triggering switch and a sensor coupled to said automatic triggering switch and mounted adjacent said wire coil, whereby actuation of the manual triggering switch causes energy from the electric power source to be passed to the coil to produce a magnetic field for a selected period of time, and whereby the energizing of the automatic triggering switch enables the sensor and wherein the sensed position of the vehicle by the sensor causes the voltage within the capacitor to be passed to the wire coil which causes a magnetic force which magnetically effects the vehicle.

6. The magnetic propulsion toy system of claim 5 wherein said sensor is an infrared light emitter and detector.

7. The magnetic propulsion toy system of claim 5 wherein said control circuit further comprises a manual delay triggering switch coupled to said sensor, whereby with the automatic triggering switch de-energized the manual actuation of the delay trigger switch enables the sensor for a selected time period and wherein the sensed position of the vehicle by the sensor causes the voltage within the capacitor to be passed to the wire coil which causes a magnetic force with magnetically effects the vehicle.

8. A magnetic propulsion toy system comprising:

a track;

a vehicle adapted to ride upon said track, at least a portion of said vehicle being made of a magnetic material;

a wire coil mounted about a portion of said track for passage of said vehicle therethrough;

an electric power source coupled to said wire coil;

and a control circuit coupled to said power source and said wire coil which controls the passage of current to said wire coil, said control circuit includes a manual triggering switch and time limiting means coupled to said manual triggering switch for limiting the time said wire coil is energized to a selected time interval, a light source coupled to said capacitor, wherein the discharge of the capacitor also causes the energizing of the light source for a selected time period, whereby actuation of the manual triggering switch causes energy from the electric power source to be passed to the coil to produce a magnetic field for a selected period of time.

9. The magnetic propulsion toy system of claim 2 further comprising a light source coupled to said capacitor, wherein the discharge of the capacitor also causes the energizing of the light source for a selected time period.

10. A magnetic propulsion toy system comprising:

a vehicle at least a portion of which being made of a magnetic material;

a track configured to receive said vehicle;

a wire coil mounted adjacent said track for passage of said vehicle therethrough;

an electric power source coupled to said wire coil;

and a control circuit coupled to said power source and said wire coil which controls the passage of current from said power source to said wire coil, said control circuit includes a manual delay triggering switch coupled to a sensor mounted to sense the presence of said vehicle adjacent said wire coil, whereby manual actuation of the delay trigger switch enables the sensor for a selected time period and wherein the sensed position of the vehicle by the sensor causes the current from said power source to be passed to the wire coil to cause a magnetic force with magnetically effects the vehicle.

11. The magnetic propulsion toy system of claim 10 wherein said delay triggering switch has time variable means for varying the length of the selected time period said sensor is enabled.

12. The magnetic propulsion toy system of claim 10 wherein said control circuit includes a capacitor coupled to said power source and said delay trigger switch.

13. The magnetic propulsion toy system of claim 10 wherein said control circuit includes a manual triggering switch having an enabled position which causes voltage to be passed to said wire coil and a disabled position wherein voltage is not passed to to said wire coil, whereby actuation of the manual triggering switch causes the current to be passed immediately to the wire coil which causes a magnetic force with magnetically effects the vehicle.

14. The magnetic propulsion toy system of claim 10 wherein said manual delay triggering switch has time variable means for varying the length of the selected time period said sensor is enabled.

15. The magnetic propulsion toy system of claim 10 wherein said sensor is an infrared light emitter and detector.

16. The magnetic propulsion toy system of claim 10 wherein said control circuit further comprises an automatic triggering switch coupled to said sensor and mounted adjacent said wire coil, whereby the actuation of the automatic triggering switch enables the sensor and wherein the sensed position of the vehicle by the sensor causes the voltage to be passed to the wire coil which causes a magnetic force with magnetically effects the vehicle.

17. The magnetic propulsion toy system of claim 10 further comprising a light source coupled to said power source.

18. The magnetic propulsion toy system of claim 12 further comprising a light source coupled to said capacitor.

19. A magnetic propulsion toy system comprising:

a track;

a vehicle adapted to ride upon said track, at least a portion of said vehicle being made of a magnetic material;

a wire coil mounted about a portion of said track for passage of said vehicle therethrough;

an electric power source coupled to said wire coil;

and a control circuit coupled to said power source and said wire coil which controls the passage of current to said wire coil, said control circuit includes a triggering switch and a capacitor coupled to said triggering switch and coupled to said electric power source for temporarily storing electrical energy, whereby actuation of the triggering switch causes energy from the energy storage means to be passed to the coil to produce a magnetic field.

20. The magnetic propulsion toy system of claim 19 further comprising a vehicle position sensor and wherein said triggering switch is a manual delay triggering switch.

21. The magnetic propulsion toy system of claim 19 wherein said triggering switch is a manual triggering switch.

22. A magnetic propulsion toy system comprising:

a track;

a vehicle adapted to ride upon said track, at least a portion of said vehicle being made of a magnetic material;

a wire coil mounted about a portion of said track for passage of said vehicle therethrough;

an electric power source coupled to said wire coil;

and a control circuit coupled to said power source and said wire coil which controls the passage of current to said wire coil, said control circuit includes a triggering switch and energy storage means coupled to said triggering switch and coupled to said electric power source for temporarily storing electrical energy, a light source coupled to said capacitor, whereby actuation of the triggering switch causes energy from the energy storage means to be passed to the coil to produce a magnetic field.

* * * * *